US006408761B1

(12) United States Patent
Arai et al.

(10) Patent No.: US 6,408,761 B1
(45) Date of Patent: Jun. 25, 2002

(54) BLASTING APPARATUS

(75) Inventors: Hiroaki Arai; Hidehiko Maehata; Hajime Yoshii; Toshiaki Enomoto; Taisuke Ishihara, all of Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 0 days.

(21) Appl. No.: 09/392,939

(22) PCT Filed: Mar. 13, 1998

(86) PCT No.: PCT/JP98/01091

§ 371 (c)(1),
(2), (4) Date: Sep. 9, 1999

(87) PCT Pub. No.: WO98/43039

PCT Pub. Date: Oct. 1, 1998

(30) Foreign Application Priority Data

Mar. 26, 1997 (JP) ..... 9-72529
Oct. 27, 1997 (JP) ..... 9-293076

(51) Int. Cl.[7] ..... F42B 3/10; F42C 19/12
(52) U.S. Cl. ..... 102/302; 102/202.7
(58) Field of Search ..... 102/202.7, 302, 102/312, 313

(56) References Cited

U.S. PATENT DOCUMENTS

| | | | | | |
|---|---|---|---|---|---|
| 2,916,994 | A | * | 12/1959 | O'Neill, Jr. | 102/202.7 X |
| 3,208,380 | A | * | 9/1965 | Scherrer | 102/202.7 |
| 3,315,603 | A | * | 4/1967 | Amey et al. | 102/202.7 |
| 5,291,828 | A | * | 3/1994 | Nerheim et al. | 102/202.7 |
| 5,431,104 | A | * | 7/1995 | Barker | 102/202.7 X |
| 5,533,454 | A | * | 7/1996 | Ellis et al. | 102/202.7 X |
| 5,756,925 | A | * | 5/1998 | Frank et al. | 102/202.7 |
| 5,789,697 | A | * | 8/1998 | Engelke et al. | 102/202.7 X |

FOREIGN PATENT DOCUMENTS

| | | | | |
|---|---|---|---|---|
| GB | 1105663 | * | 3/1968 | 102/202.7 |
| JP | 1117188 | * | 6/1986 | 102/202.7 |

* cited by examiner

*Primary Examiner*—Peter A. Nelson
(74) *Attorney, Agent, or Firm*—Reising, Ethington, Barnes, Kisselle, Learman & McCulloch, P.C.

(57) ABSTRACT

A melting/vaporization substance 2 is melted and vaporized by supplying an electric energy of a predetermined amount from an electric energy supply circuit to the melting/vaporization substance 2. An explosive blasting substance 3 is exploded by a phenomenon caused in a process of melting and vaporization of the melting/vaporization substance 2, so that a to-be-blasted object 4 is blasted by that explosive force.

1 Claim, 2 Drawing Sheets

BLASTING APPARATUS

TECHNICAL FIELD

This invention relates to a blasting apparatus for blasting a to-be-blasted object such as a concrete construction or a rock base by melting and vaporizing a melting/vaporization substance (e.g., metallic fine wire) by supplying electrical energy for a short time and then exploding an explosive blasting substance by a phenomenon of a process accompanying the vaporization.

BACKGROUND ART

According to the prior art, as a blasting apparatus for blasting a concrete construction or a rock base, there is a type which includes a dynamite and a detonator in which explosive powder is filled internally as a means for exploding the dynamite.

For the dynamite, an explosive powder having a poor sensitivity which is not easy to explode even if some shock is applied or a flame flashes over is used so as to secure safety of handling. Because of this, the detonator contains an explosive powder which is relatively easy to explode. By exploding the explosive powder contained in the detonator by a fire or electric spark, the explosive powder contained in the dynamite is exploded by a caused shock. However, because an explosive powder relatively easy to explode is contained in the detonator, if leakage current from machines disposed around a stock yard or current caused by surge or lightning is supplied to the detonator, there is a danger that the detonator explodes.

Accordingly, an object of the present invention is to provide a blasting apparatus capable of solving the aforementioned problem.

DISCLOSURE OF INVENTION

The present invention provides a blasting apparatus in which an explosive blasting substance is filled in a blasting container, melting/vaporization substance which is melted and vaporized rapidly when an electric energy of a predetermined amount is supplied thereto for a short time is provided in the blasting substance so that the melting/vaporization substance is exposed, an electric energy supply circuit for supplying the electric energy to the melting/vaporization substance is provided, and the blasting substance is exploded by a phenomenon caused in a process of melting and vaporization of the melting/vaporization substance so as to blast a to-be-blasted object by the explosive force.

In a structure of the present invention, when an electric energy of a predetermined amount is supplied from an electric energy supply circuit to a melting/vaporization substance, the melting/vaporization substance is melted and vaporized rapidly. The explosive blasting substance is exploded by a phenomenon in a process of melting/vaporization of the melting/vaporization substance so as to blast a to-be-blasted object by the explosive force. Further, even if leakage current is supplied from surrounding devices, as long as an electric energy enough for the melting/vaporization substance to be melted and vaporized is not supplied, the blasting substance is not exploded, thereby improving the safety in handling the blasting apparatus.

Further, the present invention provides a blasting apparatus in which an explosive blasting substance is filled in a blasting container mounted in a mounting hole formed in a to-be-blasted object, a metallic fine wire which is melted and vaporized rapidly when an electric energy of a predetermined amount is supplied thereto for a short time is provided in the blasting substance such that the metallic fine wire is exposed, an electric energy supply circuit for supplying the electric energy to the metallic fine wire is provided, and the blasting substance is exploded by supplying the electric energy to the metallic fine wire for a short time so as to melt down the wire, so that the to-be-blasted object is blasted by the explosive force.

In a structure of the present invention, when an electric energy of a predetermined amount is supplied from an electric energy supply circuit to a metallic fine wire, the metallic fine wire is fused (melted/vaporized) so that short-circuit occurs, and the blasting substance catches fire and then is exploded. The to-be-blasted object is blasted by this explosive force. Further, even if leakage current occurs from surrounding devices, as long as electric energy enough for the metallic fine wire to be fused is not supplied, the blasting substance is not exploded. Thus, the safety in handling the blasting apparatus is improved.

BEST MODES FOR CARRYING OUT THE INVENTION

Figure 1:
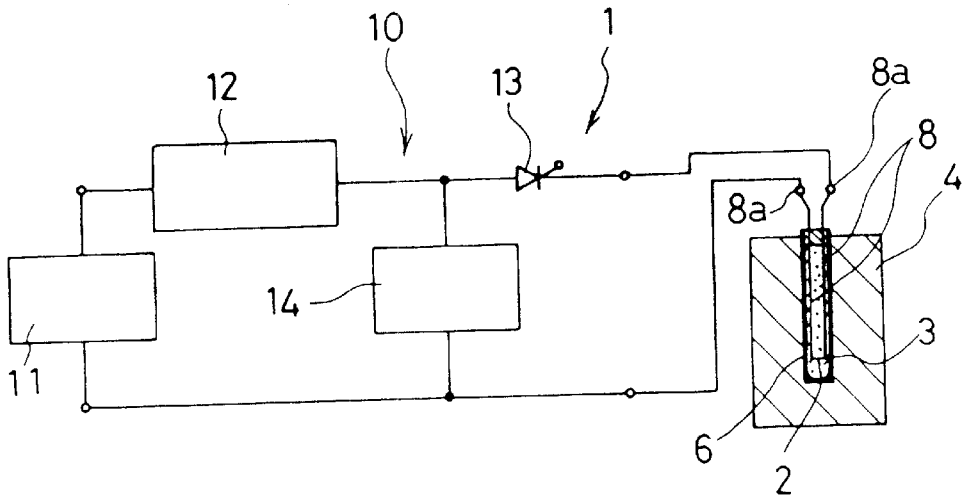
FIG. 1 is a sectional view showing an entire structure of a blasting apparatus according to the present invention, in which a blasting container is mounted in a mounting hole formed in a to-be-blasted object.
Figure 2:
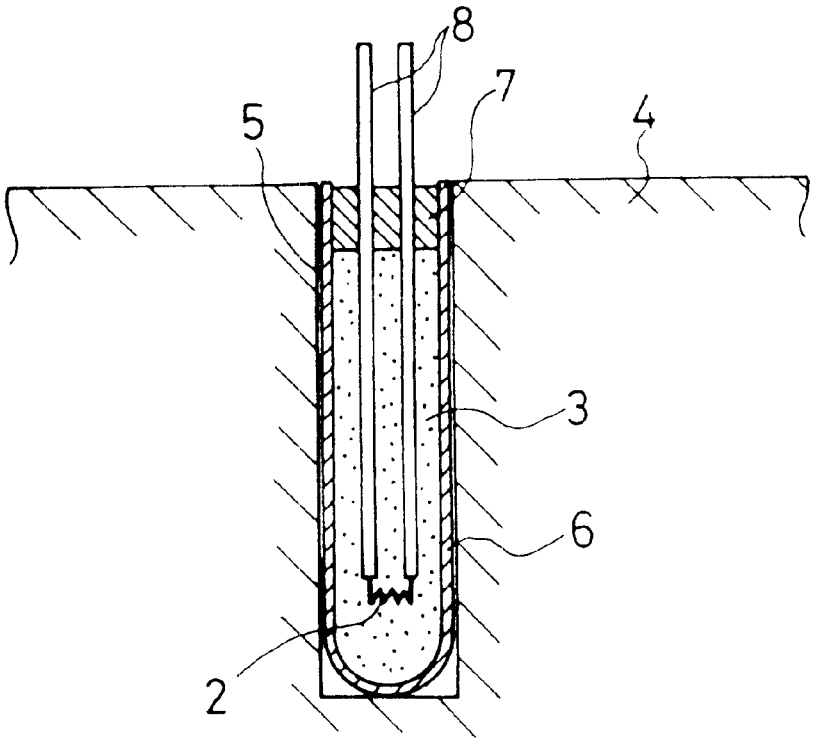
FIG. 2 is an enlarged sectional view showing a state in which a blasting container is mounted in a mounting hole formed in a to-be-blasted object.

The present invention will be described in detail with reference to the accompanying FIGS. 1 and 2.

In a blasting apparatus 1 according to the present invention, metallic fine wire of copper: Cu formed to be 0.3 mm in diameter as melting/vaporization substance is vaporized rapidly and a blasting substance 3 is exploded by a shock caused by a phenomenon accompanying the vaporization, such as discharge, spark, heat and vaporization expansion, so as to blast a to-be-blasted object such as a concrete construction or a rock base.

As the blasting substance 3, explosives or explosive compounds other than the explosives are used. The explosives mean an explosive, a high explosive and an ammunition as described in the "New Edition: Industrial Explosives" issued by the Industrial Explosives Society of Japan. In this style, blasting powder and smokeless powder are used as explosive, and DDNP, mercury fulminate and the like are used as high explosive. Explosive compounds other than the explosives include, for example, methyl nitrate, nitro-compound, gasoline and the like as described in "Chemical Handbook" complied by the Chemical Society of Japan.

In the blasting apparatus 1 of the present invention, the aforementioned blasting substance 3 is filled in a blasting container 6 mounted in a mounting hole 5 formed in a to-be-blasted object 4. An opening side of this blasting container 6 is sealed by a lid member 7 and a pair of electrodes 8 are inserted through this lid member 7. Ends of these electrodes 8 are connected with each other by the aforementioned metallic fine wire 2 exposed to the blasting substance 3.

As a material of the aforementioned blasting container 6, a non-metal such as wood, paper or synthetic resin, or a metal such as aluminum or iron is used.

An electric energy supply circuit 10 is connected to the metallic fine wire 2 so as to supply electric energy of a predetermined amount (e.g., 5,000 V) enough to melt and vaporize the metallic fine wire 2.

This electric energy supply circuit 10 comprises a power supply unit 11, a capacitor 14 connected between this power supply unit 11 and both terminals 8*a*, a charge control circuit 12 which is connected between the power supply unit 11 and one side terminal 8*a* so as to control the capacitor 14 to store an electric energy of a predetermined amount (e.g., 400 $\mu$F), and a discharge switch 13 which is connected between this charge control circuit 12 and the one terminal 8*a*.

The aforementioned blasting apparatus 1 is manufactured by connecting both ends of the electrodes 8 to each other with the metallic fine wire 2, inserting the electrodes 8 through the lid member 7, filling the blasting container 6 with the blasting substance 3, fitting the lid member 7 to the blasting container 6 to seal the blasting substance 3, and connecting the electric energy supplying circuit 10 to the terminals 8a of the electrodes 8. Then, the blasting container 6 is mounted in the mounting hole 5 formed in the to-be-blasted object 4.

Then, an electric energy of a predetermined amount necessary for melting and vaporizing the metallic fine wire 2 is stored in the capacitor 14 and the discharge switch 13 is turned on. As a result, the aforementioned electric energy is supplied to the metallic fine wire 2 for a short time so that the metallic fine wire 2 is melted and vaporized. By the aforementioned phenomenon accompanying the process of melting and vaporization, the blasting substance 3 is exploded. Then, the explosive force of the blasting substance 3 is combined with a shock caused by the melting and vaporization of the metallic fine wire 2, whereby the to-be-blasted object 4 is securely blasted and made fragile.

According to the present invention, the blasting container is filled with the blasting substance 3 and instead of the detonator, the metallic fine wire 2 connected to the electrodes 8 is used. Therefore, even if leakage current occurs from surrounding devices and is supplied to the metallic fine wire 2, as long as electric energy enough for melting and vaporizing the metallic fine wire 2 is not supplied, the blasting substance 3 is not exploded. Thus, the blasting apparatus can be handled under the safety.

Meanwhile, since nitromethane is not exploded until a large shock of more than about 70 ton·f/cm$^2$ is supplied thereto, an explosive needs be used to explode this nitromethane. Therefore, nitromethane has seldom been used in the prior art. However, a sufficient shock for exploding nitromethane can be secured by a shock caused when the metallic fine wire 2 is melted and vaporized, thereby allowing nitromethane to be used as the blasting substance 3. By using nitromethane, the same explosive force as when dynamite is used can be obtained, so that the to-be-blasted object can be securely blasted and made fragile by the great explosive force of nitromethane.

Although an example of using the metallic fine wire 2 as the melting/vaporization substance has been described in the above embodiment, it is permissible to use a small piece of metal or a conductive material such as carbon formed in an appropriate shape, as other example of the melting/vaporization substance. When such materials are used, the blasting substance 3 is also exploded by the phenomenon caused in a process of melting and vaporization in the same manner as in the above embodiment, so that the to-be-blasted object 4 can be securely blasted or made fragile.

Although according to the above embodiment, the blasting container 6 is mounted in the mounting hole 5 formed in the to-be-blasted object 4, it is permissible, without being restricted to this example, to butt the blasting container 6 to the surface of the to-be-blasted object 4 or to hoist the blasting container with an appropriate hoisting tool so that it is disposed in the vicinity of the surface of the to-be-blasted object 4. In any case, by supplying electric energy to the metallic fine wire 2 (a small piece of metal or a conductive material such as carbon), the metallic fine wire 2 is melted and vaporized rapidly so that the blasting substance 3 is exploded by the phenomenon accompanying that process. As a result, the to-be-blasted object 4 is blasted and made fragile by the shock caused in the process of melting and vaporization of the metallic fine wire 2 and the explosive force of the blasting substance 3.

Further, by adjusting the blasting force of the blasting apparatus 1 of the above embodiment, this blasting apparatus 1 can also be used as a focus apparatus for geophysical prospecting.

INDUSTRIAL APPLICABILITY

As described above, the blasting apparatus of the present invention is suitable for blasting a to-be-blasted object requiring a massive blasting force.

What is claimed is:

1. A blasting apparatus in which a material selected from the group consisting of nitromethane and gasoline is filled in a blasting container, a melting/vaporization substance which is melted and vaporized rapidly when an electric energy of a predetermined amount is supplied thereto for a short time is provided in said material so that said melting/vaporization substance is exposed, an electric energy supply circuit for supplying said electric energy to said melting/vaporization substance is provided, and said material is capable of being exploded by a phenomenon caused in a process of melting and vaporization of said melting/vaporization substance so as to blast a to-be-blasted object by the explosive force.

* * * * *